US005913869A

United States Patent [19]

Reil

[11] Patent Number: 5,913,869

[45] Date of Patent: Jun. 22, 1999

[54] UNIVERSAL CARTRIDGE

[76] Inventor: Vladimir Reil, 32450 Nautilus Dr., Rancho Palos Verdes, Calif. 90274

[21] Appl. No.: 09/042,491

[22] Filed: Mar. 16, 1998

[51] Int. Cl.[6] ..... A61B 17/34

[52] U.S. Cl. ..... 606/188; 606/167; 606/182; 606/184; 606/185

[58] Field of Search ..... 606/167, 188, 606/182, 184, 185

[56] References Cited

U.S. PATENT DOCUMENTS

| | | | |
|---|---|---|---|
| D. 282,779 | 2/1986 | Reil | 24/23 |
| D. 315,211 | 3/1991 | Reil | 24/25 |
| D. 347,895 | 6/1994 | Mann | 24/146 |
| D. 358,210 | 5/1995 | Reil | 24/146 |
| D. 366,316 | 1/1996 | Reil | 24/146 |
| 3,941,134 | 3/1976 | McDonald | 128/330 |
| 4,030,507 | 6/1977 | Mann | 606/188 |
| 4,146,032 | 3/1979 | Rubenstein et al. | 128/330 |
| 4,527,563 | 7/1985 | Reil | 128/329 |
| 4,860,747 | 8/1989 | Sciara | 606/188 |
| 4,921,494 | 5/1990 | Reil | 606/188 |
| 4,931,060 | 6/1990 | Aue | 606/188 |
| 5,004,470 | 4/1991 | Mann | 606/188 |
| 5,004,471 | 4/1991 | Mann | 606/188 |
| 5,007,918 | 4/1991 | Mann | 606/88 |
| 5,211,653 | 5/1993 | Nakajima | 606/188 |
| 5,263,960 | 11/1993 | Mann | 606/188 |
| 5,350,394 | 9/1994 | Mann | 606/188 |
| 5,360,434 | 11/1994 | Mann | 606/188 |
| 5,389,105 | 2/1995 | Mann | 606/188 |
| 5,441,514 | 8/1995 | Durham | 606/188 |
| 5,496,343 | 3/1996 | Reil | 606/188 |
| 5,499,993 | 3/1996 | Blomdahl et al. | 606/188 |

*Primary Examiner*—Michael Buiz
*Assistant Examiner*—(Jackie) Tan-uyen Ho
*Attorney, Agent, or Firm*—Cislo & Thomas LLP

[57] ABSTRACT

The universal cartridge provides sterile conditions by which ears may be pierced by a variety of different stud gun types and models thereby decreasing the inventory which a merchant must maintain. A chassis slideably holds a carriage inside a cover that may be sealed for sterilization and to maintain sterile conditions. The carriage is especially constructed to have interlocking pieces that disengage upon completion of the ear piercing process. The chassis may be constructed such that the interlocking nature of the carriage is employed to both hold and release the pierced earring stud. The cover serves to provide means by which the cartridge and chassis may be manipulated without direct handling and also to provide means by which a removable seal may be used to provide and maintain sterile conditions. The universal cartridge of the present invention may be used in conjunction with a variety of models and types of stud guns not only to enhance the piercing procedure safety and accuracy but also such that earrings of all varieties and sorts may be used to pierce ears by a variety of different styles and types of stud guns.

20 Claims, 7 Drawing Sheets

UNIVERSAL CARTRIDGE

BACKGROUND OF THE INVENTION

1. Field of the Invention

This invention relates to devices and apparatus used in conjunction with piercing ears, more particularly to a universal cartridge for holding a pierced earring in a form that may be used in a number of earring stud guns and/or makes existing stud guns more effective and efficient in operation.

2. Description of the Related Art

The piercing of ears for jewelry purposes was once a minor operation. However, the procedure is now more casual. Yet, it remains important to pierce ears in a sterile, controlled, and reliable manner. A number of devices such as stud guns have allowed the health-conscious seller of earrings and the like to perform the ear piercing process under sanitary conditions.

Generally, a pierced earring (having a pierced earring stud with a projecting pin and a nut or clasp that engages the end of the pin) is driven in a quick, forceful, but precise manner through the ear so as not to inflict injury upon the ear tissue or other tissue being pierced. The marketplace currently encompasses a number of devices providing quick, sanitary, and simple means by which ears may be pierced with pierced earring studs. A common configuration has a stud gun that serves as the alignment and driving means by which the pierced earring is inserted into the ear. Individual and self-contained cartridges provide a chassis and cover that hold a pierced earring under sterile conditions until ready for use. The chassis may have a nut-supporting portion that holds nuts in alignment with the earring post or stud with a carriage of one kind of another carrying the earring stud and allowing it to be inserted through the ear and onto the nut.

Increasingly, with the variety of stud guns available on the marketplace, it becomes a difficult and restrictive factor to have pierced earring cartridges dedicated to only one type of gun. It forces the proprietor to carry a large number of stud guns in order to accommodate the desires or fancies of the customer with respect to earrings and the piercing of ears with respect thereto. It is more advantageous if a universal pierced earring cartridge is available that fits a number of stud guns so that a greater variety and number of pierced earrings can be used in conjunction with the ear piercing process. Thus, a universal system and technique for piercing ears is now available that is ideally suited for safe and effective ear piercing when used with the disclosed stud gun and even enhances the operation of other, prior art conventional stud guns.

Not only does the universal cartridge of this invention attain economic values not heretofore available, because of decreased inventory and the like, but it also contributes to the health and safety of both ear piercer and the person having their ears pierced.

That is to say, some prior art stud guns do not have the combined ability to safely and accurately position and place a stud in the ear. The stud gun with associated universal cartridge of the invention allows the operator of the stud gun to see, because of the transparency of the cartridge, exactly what is being positioned in the stud gun. Additionally, the universal cartridge allows for safely and accurately associating stud and nut or clasp and there is no need to reposition the stud and nut or clasp after the initial piercing procedure. Many times the prior art cartridges are opaque and also require manual positioning of the stud and partially associated nut or clasp, before or after nut association during the piercing or post-piercing process, requiring, if sanitary conditions are to be observed, repositioning of stud and nut or clasp with a gloved hand.

SUMMARY OF THE INVENTION

The present invention is directed primarily towards a universal cartridge for pierced earrings. Such earrings generally have a stud head and post or pin, with the post or pin being generally sharp or pointed at its end for a more easy fit into previously-pierced ears or during an ear piercing process. The pierced earring stud post is engaged at its end by a nut or clasp that serves to hold pointed end in engagement with any propitious narrowing of the stud post and in order to better retain the clasp thereon.

A chassis provides rails, detents, guides, and the like in order to guide a carriage holding the pierced earring stud in aligned engagement while it is forcefully driven towards the nut so as to pierce an ear. A transparent cover fits snugly and securely, but removably, over the top of the chassis so as to enclose the chassis along with the earring post and stud. A removable seal or the like may provide an enclosed environment in which sterilizing gas such as ethylene dioxide may be used in order to sterilize the entire cartridge system.

In the present invention, the carriage is provided by two interlocking pieces that slide along a central rail present in the chassis. The carriage holds the earring stud at its head. It has two interfitting and interlocking pieces through which an aperture passes so as to provide better engagement with the driving push rod of the stud gun. Two lower projections on the carriage provide means by which the interlocking pieces of the carriage may separate with respect to the central rail upon which they travel. In so separating, the earring stud is released after it has engaged the nut or clasp and after the driving pin of the stud gun is pulled back and removed from the aperture defined by the interlocking pieces of the carriage.

Upon separation with respect to the rail, the interlocking pieces release the earring stud so that the newly-pierced ear and associated earring may be removed from the ear piercing apparatus. Detents hold the carriage in a forward position so that the driving pin of the stud can then disengage the carriage. The transparent cover may then be replaced over and reengage the chassis with the carriage in the forward position. The entirety of the cover-chassis system may then be removed from the stud gun and disposed of as the ear has been pierced in a sterile manner. The universal cartridge of the present invention is composed of disposable or recyclable material that, while sturdy, is manufactured and disposed of at minimal expense.

In providing such a universal cartridge, earrings of many characteristics, types, and sorts can be used to pierce ears in a manner consistent with customer preferences, available stud guns, and other ear piercing apparatus.

With the use of the transparent cover, the ear piercer may see what she or he is doing and the flexible side walls of the cover allow for ease of grasping with the thumb and fingers of the operator to frictionally retain the used cartridge for disposal purposes, without fear of the operator or person having their ears pierced being contaminated with, for example, contaminates during the piercing process.

OBJECTS OF THE INVENTION

It is an object of the present invention to provide a universal pierced earring cartridge that may fit a number of pierced earring stud guns.

It is another object of the present invention to provide a universal cartridge for pierced earrings that provide, among other things, facile disengagement of the pierced earring stud once the ear has been pierced.

It is another object of the present invention to provide a universal cartridge for pierced earrings that is easily and generally inexpensively manufactured that provides a sterile environment for its components, comprising the pierced earring.

It is an object of the present invention to provide an integral ear piercing system that enhances sterility of the ear-piercing process or post-piercing process.

It is another object of the present invention to provide an integral ear piercing system that reduces the likelihood that ear tissue will be trapped and/or pinched between the earring stud post and the earring clasp or nut.

It is an additional object of the present invention to provide a sterile package within which pierced earrings may be provided.

It is another object of the present invention to provide such a sterile package that retains a supporting base inside the sterile package until intentionally and manually removed by a person performing the ear-piercing process.

It is another object of the present invention to provide graspable or other means by which the supporting base may be engaged without contact between the earring ornaments and other objects such as a person's hands.

It is yet another object of the present invention to prevent accidental contamination of sterile earring ornaments by removably retaining a supporting base within a sterile container once the seal of the sterile container has been broken.

It is still another object of the invention to supplant the opaque earring cartridge of the prior art with a transparent cartridge, thereby decreasing the degree of training needed for the ear-piercer operator.

It is still a further object of the invention to provide transparent cartridges containing uniquely configured studs and clasps or nuts that are designed to be properly assembled in associated fashion without the need for manual manipulation.

It is still another important object of the invention to provide a universal cartridge capable of being associated with existing, conventional stud guns that improve the stud guns' operation and increase the safety and efficacy of the stud and clasp association.

It is still another important object to provide a universal cartridge that takes the guesswork out of the ear piercing process also thereby minimizing the degree of expertise needed because the universal cartridge does the overall process without the need for discretion on the part of the operator and specifically eliminates the need for after piercing adjustment required in some prior art cartridges.

These and other objects and advantages of the present invention will be apparent from a review of the following specification and accompanying drawings.

DESCRIPTION OF THE PREFERRED EMBODIMENT(S)

Figure 1:
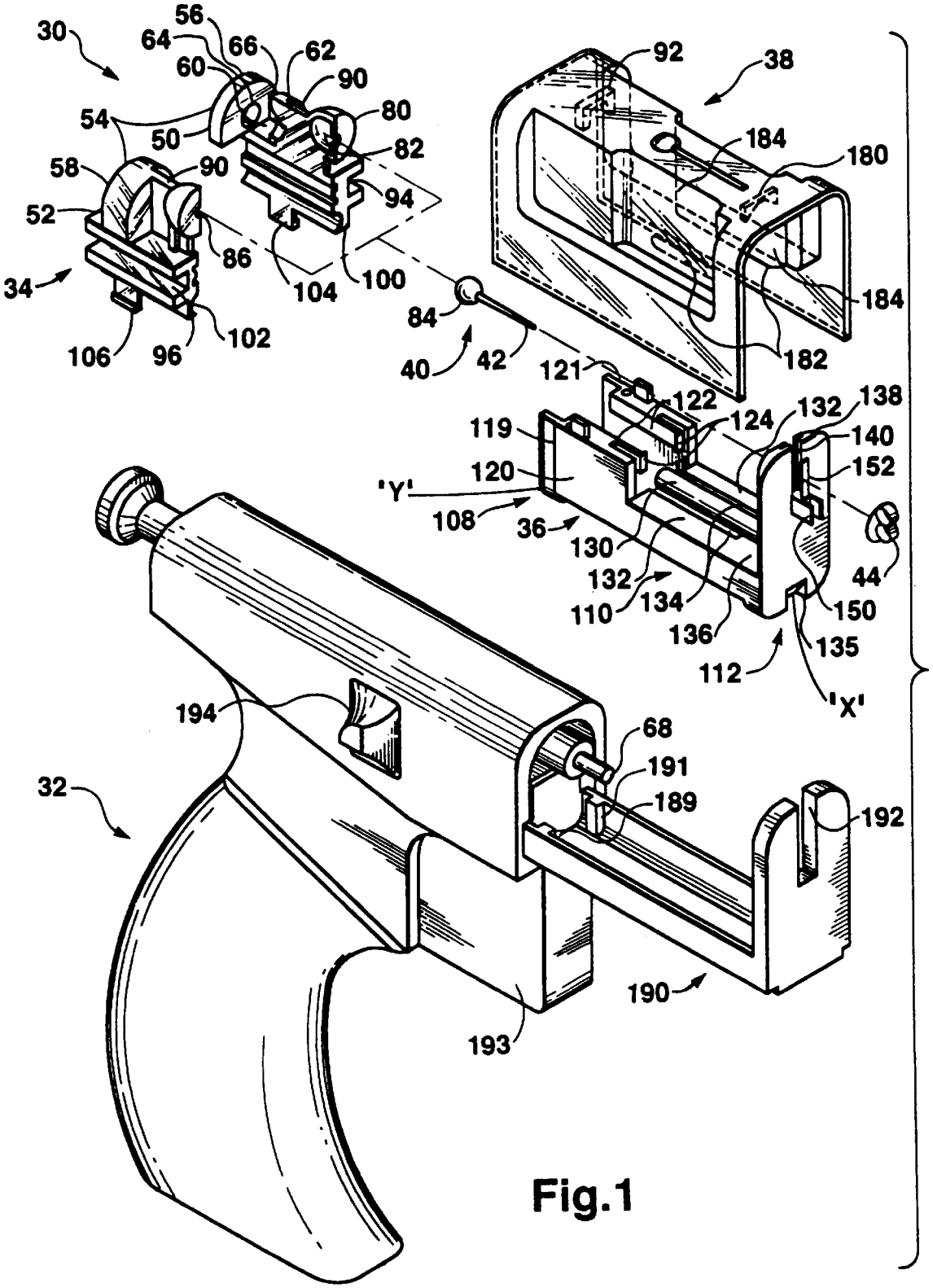
FIG. 1 is a right front perspective and partially exploded view of the universal cartridge of the present invention along with the stud gun in conjunction with which a universal cartridge is used.
Figure 8:
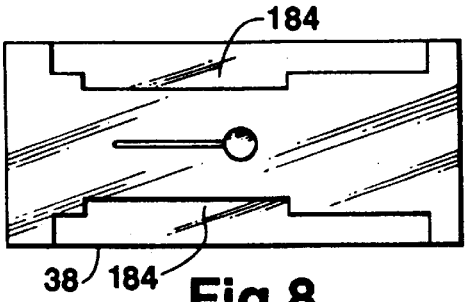
FIG. 8 is a top plan view of the cover of FIG. 7.

As shown in the drawings wherein like numerals of reference designate like elements throughout, the universal cartridge for pierced earrings of the present invention provides means by which a cartridge for piercing ears is provided that may be effectively employed with a variety of stud guns.

FIG. 1 shows the universal cartridge for pierced earrings of the present invention 30 in an exploded view above a stud gun 32 of known design and construction. Universal cartridge 30 has a carriage 34, a chassis 36 and a cover 38. The carriage 34 slidably engages the chassis 36 and the entirety thereof is covered by the cover 38. A detachable seal may serve to encompass the open portions of the universal cartridge 30 not kept secure by the cover 38. Ethylene dioxide or other sterilizing gas may be used to sterilize the contents of the universal cartridge 30 to ensure a sterile environment and sterile operating components for the ear piercing process. Of primary importance is the sterile nature of the earring stud 40 particularly its post 42, as well as the earring stud nut 44.

The carriage 34 has two interlocking left and right pieces. The left portion 50 of the carriage 34 is generally a mirror image of the right side 52 of the carriage. Generally, the only difference between the left side 50 and the right side 52 of the carriage 34 that would prevent the two sides from being mirror images of one another is the interlocking portion 54.

The interlocking portion 54 has two offset leaves, a left interlocking leaf 56 and a right interlocking leaf 58. One of these leaves may be at the rearward most portion of the carriage 34, while another adjoining leaf may be offset forwardly thereof so that a snug fit may be present between the two.

In the drawings, the left interlocking leaf 56 is at the rearmost portion of the left side 50 of the carriage 34. A channel 60 is defined between the left interlocking leaf 56 and a forward half portion 62, the channel 60 matching the projecting portion of the right interlocking leaf 58. As mentioned above, the right interlocking leaf 58 fits snugly but smoothly into the interlocking leaf channel 60. Due to the close fit between the leaf elements, no twisting or rotation with respect to the left 50 and right 52 sides of the carriage 34 occurs and the earring stud 40 is securely held by the carriage 30.

A central aperture 64 is present through both the left interlocking leaf 56 and the right interlocking leaf 58. As described in more detail below, the leaf aperture 54 serves as means by which the driving pin of the stud gun 32 engages and drives the carriage 30. A stud gun pin stop 66 or the like serves as means by which the stud gun pin 68 engages and drives the carriage 30 along its course as defined by the chassis 36.

Figure 3:
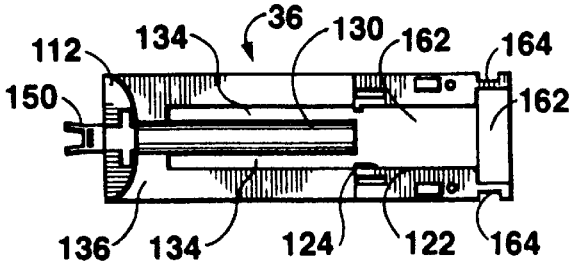
FIG. 3 is a top view of the universal cartridge chassis.
Figure 7:
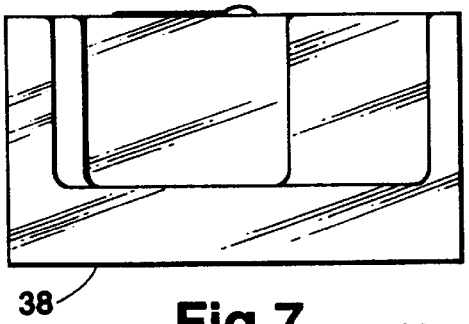
FIG. 7 is a left side view of the cover used in conjunction with the universal cartridge system of the present invention.

As the left and right sides 50, 52 of the carriage 34 are generally mirror images of one another, description of the elements on one of the sides of the carriage 34 generally serves to describe the corresponding elements on the other side. As shown in FIGS. 1 and 3, a carriage 30 has an earring stud holder 80 having a plenum or open space 82 that provides room for the earring stud head 84. A pin aperture 86 provides means by which the earring stud head 84 may be held by the holder 80 while allowing the earring stud pin 42 to project forwardly through the pin aperture 86. This allows the pointed end of the earring post 42 not only exposure but also alignment at all piercing angles so that it might pierce the intervening ear tissue and engage the nut 44.

A bridge 90 serves as a rearward support that intermediates the propulsive force of the stud gun pin 68 from the pin stop 66. Additionally, a U-shaped restraint 92 serves to hold the carriage 34 in place with respect to the cover 38 by laterally engaging the bridge 90.

The carriage 34 defines oppositely opposed channels 94, 96 that serve to support the carriage 34 in place at the rearwardmost portion of the chassis 36. The forwardmost portion of the left and right carriage channels 94, 96 may have a short indentation or notch engageable by a detent or the like as may be carried by the chassis 36.

Below the left and right carriage channels 94, 96 are two corresponding and oppositely opposed projections. The first descending projections 100, 102 generally travel the entirety of the length of the base of the left and right carriage portions 50, 52. The interior of these descending projections is concavedly curved in a manner resembling one-quarter of a cylinder. When interlocked, the first and second descending projections serve to provide a channel through which a small rail or the like, as is present in the chassis, may be engaged in an open ended fashion by the carriage 34. When interlocked, the first and second descending projections 100, 102 form a semi-cylindrical aperture 104 which forms a rail channel through which a rail may pass as the carriage slides along the chassis 36. As will be seen in more detail below, particularly with respect to the operation of the carriage 34, it is of particular significance that the rail channel 104 is open-ended as it allows separating articulation of the carriage 34 about the chassis rail.

Below the two descending projections 100, 102 of the carriage 34, further descent is made by two projecting tabs 104, 106 which further descend downwardly and away from the carriage 34 for a short distance before turning laterally outward towards either side of the carriage 34 for an additional short distance. The left and right projecting tabs 104, 106 serve as means by which force can be applied upon the carriage 34 to force the two sides 50, 52 to disengage from their interlocked position, thereby releasing the pierced earring stud 40.

Having described the structure and partial function of the carriage 34, the chassis 36 serves as a support and guide upon which the carriage 34 operates.

The chassis 36 is approximately 2-½ times long as the carriage 34. The chassis 36 has a rear portion 108 that holds the carriage 34 in place during initial shipment and transport, a middle portion 110 where the carriage 34 ultimately comes to rest once the ear has been pierced, and a front portion 112 that serves as an upwardly projecting end that holds and aligns the pierced earring nut 44. The front portion 112 also provides a rear support for the ear to be pierced while it alignedly positions the earring nut 44 in place. The rear 108 and middle 110 portions of the chassis 36 are approximately the same length.

The rear portion 108 of the chassis 36 has two oppositely opposed upstanding walls 120 which serve to support channel guides 122. The channel guides 122 are oppositely opposed and project inwardly from the topmost portion of the rear upstanding walls 120. The channel guides 122 engage the right and left carriage channels 94, 96 and serve to guide them as they slide along the channel guides 122 as well as holding the carriage 34 in place. In an alternative embodiment, upwardly projecting wings or the like may stand upwardly upon the rear upstanding walls 120. However, such wings are not required for optimal operation of the universal cartridge of the present invention.

The channel guides extend generally along the line of the rear upstanding walls 120 but may be spaced apart from the rearwardmost part thereof in order to provide an easier means by which the carriage 34 may engage the chassis 36 at the channel guides 122. By spacing the channel guides 122 away from the rearward most portion of the chassis 36, the carriage 34 is generally restricted in its freedom of movement, allowing easier engagement of the carriage 34 with the chassis 36. As the projections defining the carriage channels 94, 96 are generally the same width as the upstanding walls 120, fitting the carriage 34 upon the chassis 36 becomes merely a minor task of finding the right vertical height where the chassis channel guides will fit into the carriage channels 94, 96.

Channel guides 122 terminate in extending detents 124 that are spaced away from the rear upstanding walls 120 so as to provide some ability to flex. The detents 124 terminate in inwardly projecting tabs or the like so that they may engage the sides of the carriage channels 94, 96. Particularly, the detent tabs may engage small indentations thereupon to hold the carriage 34 in place. In fact, small notches may be present at the forwardmost portion of the carriage channels 94, 96 in order to provide positive engagement with the detent tabs and to hold the carriage 34 temporarily and selectively movably in place.

When the carriage 34 is disposed upon the channel guides 122, the forward end of the rail channel 104 is immediately adjacent the rearward end of the rail 130. The rail 130 extends rearwardly from the lower end of the front portion 112 of the chassis 36. The rail 130 is spaced apart on either side from a flat landing portion 132 so as to allow the travel of the carriage 34 without obstructing the downwardly projecting portions 100, 102 that define the rail channel 104. Further support may be given to the rail 130 at the forward-most portion of the chassis near the upwardly projecting nut holder 112. In fact, the attachment of the rail 130 to the flat landing portion 132 at a front area 136 provides means by which the forward travel of the carriage 34 may be stopped. Alternatively, additional supports or stops may be present in order to obstruct the further forward motion of the carriage 34.

The front portion 112 of chassis 36 is the nut holder that alignedly holds the pierced nut or clasp 44 in proper position for engagement with the pierced earring stud post 42. The front nut-holding portion 112 stands upwardly from the chassis 36 and has a top lateral slot 138. The top lateral slot 138 allows the flange of the pierced earring nut 44 to slide into the front portion 112 and to hold the same in place. The downward opening or slot 140 perpendicular to the top lateral slot 138 serves to engage the clasping portion of the nut 44 to the rear of the downward slot. The front of the downward slot 140 allows the pierced earring nut 44 to be available and engageable by the pierced earring stud 40. An alignment projection 150 attached to the front portion 112 serves as means by which the front portion 112 of chassis 36 can be alignably engaged with the stud gun 32. The pierced earring nut 44 rests atop the alignment projection and may be further held in place by an upwardly projecting finger or tab 152 that engages the back end of the curled clasping portion of the pierced earring nut 44.

Figure 2:
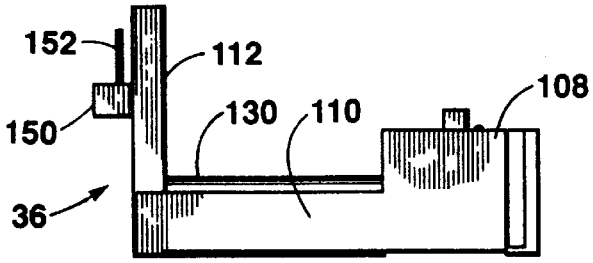
FIG. 2 is a left side view of the universal cartridge chassis.
Figure 4:
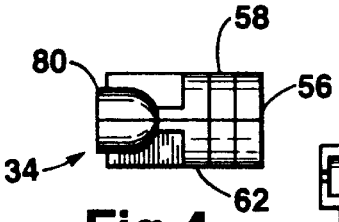
FIG. 4 is a top view of the carriage of the present invention.
Figure 5:
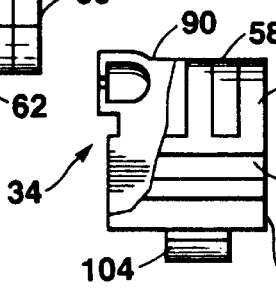
FIG. 5 is a left side and partial cut-away view of the carriage of FIG. 4.
Figure 6:
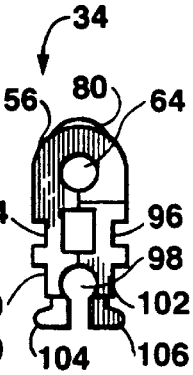
FIG. 6 is a rear view of the carriage of FIG. 4.
Figure 9:
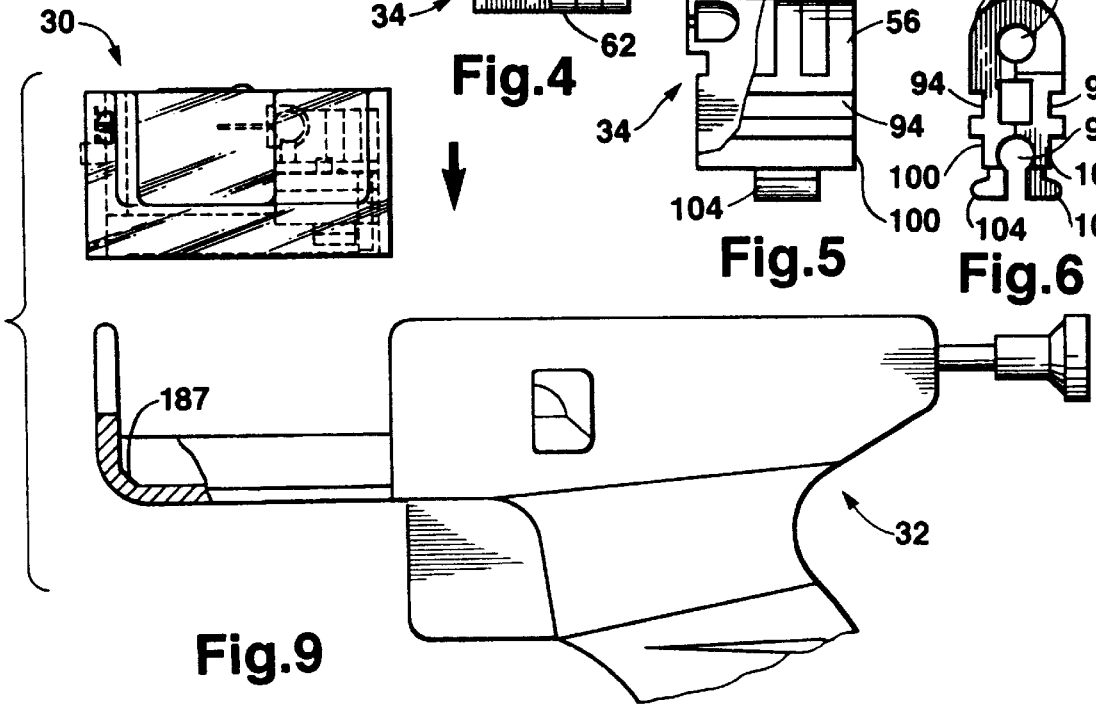
FIG. 9 is a side elevational view showing a detachable fit between the universal cartridge and a stud gun.
Figure 10:
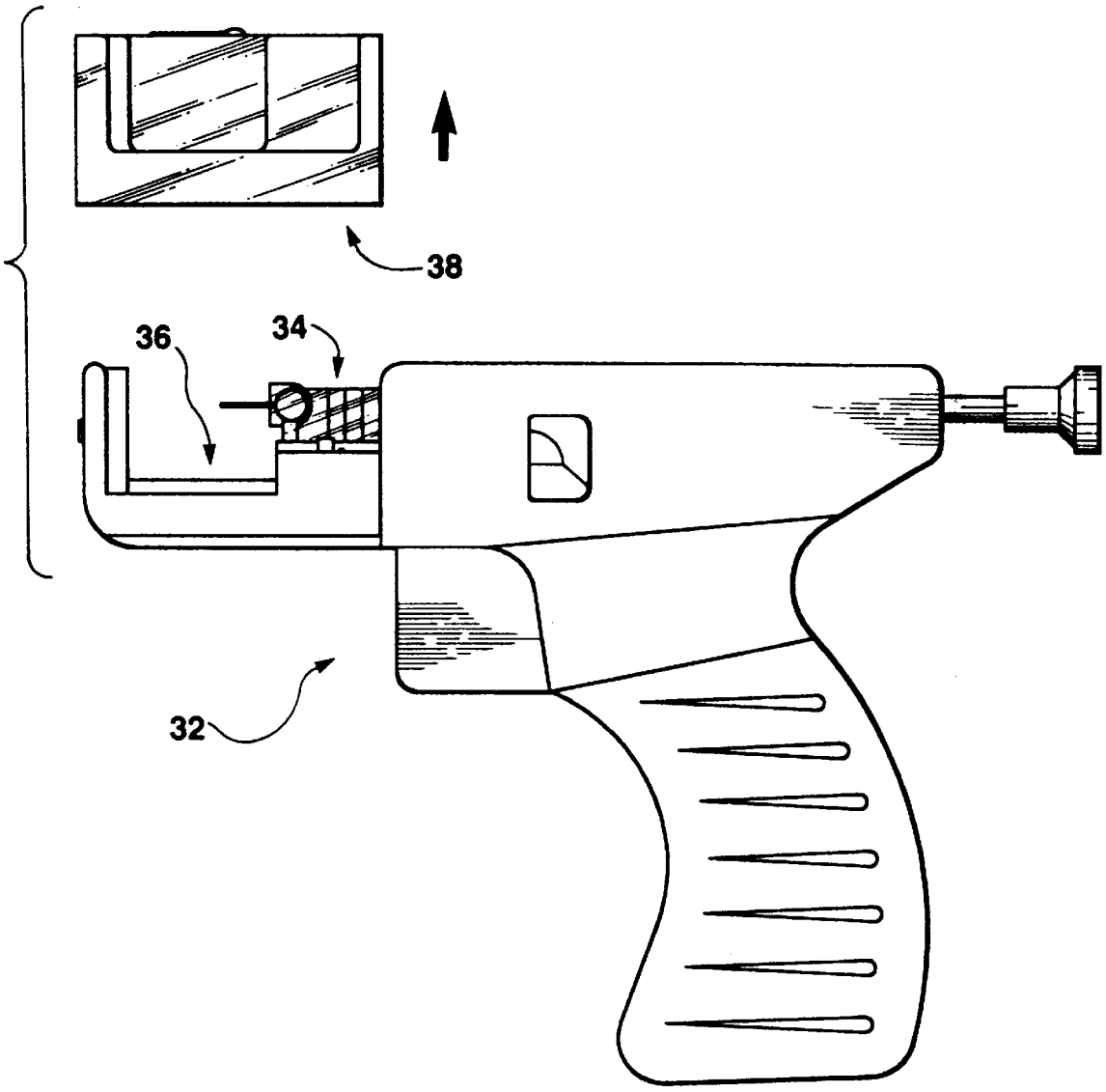
FIG. 10 is a side elevational view of the universal cartridge with the chassis and carriage fit into the stud gun and the removable cover lifted off therefrom and readied for ear insertion.

FIGS. 2–3 show the open bottom 160 of the chassis 36. A rear bottom support bar 162 serves to provide rearward support for the rear upstanding walls 120. Slots 164 may be defined on either side of the exterior of the chassis 36 at its rearward portion 108.

The bottom of the chassis 36 may have a longitudinal support 170 running the length of the rail 130 and descending downwardly to the bottom of the chassis 36. On either side of the gap 134 approximately half way along the middle portion 110 of the chassis 36 along the gap 134 below the flat landing portions 132 may be a series of tapered tabs 172. The tapered tabs 172 serve to engage the downwardly projecting tabs 104, 106 of the carriage 34. In so doing, the tapered tabs force the downwardly projecting tabs 104, 106 to move inwardly, causing the interlocking portions 50, 52 of the carriage 34 to separate about the rail 130 now engaged by the rail channel 98.

The downwardly projecting tabs 104, 106 are pressed inwardly as they move forward against the tapered tabs 172, causing their connected portions to separate outwardly to thereby disengage the pierced earring stud 40. The longitudinal support 170 not only serves to provide structural integrity to the chassis 36, but also serves to separate the two downwardly projecting tabs 104, 106 as they are pushed inwardly by the tapered tabs 172. The tapering of the tabs serves to better engage the downwardly projecting tabs 104, 106 so that during the rapid ear piercing procedure, no jams or obstruction may take place. Instead, a smooth operation occurs where the pierced earring stud 40 is delivered through the ear and is subsequently released by the carriage 34.

The cover 38, having depressible sides, is constructed to generally conform to the exterior of the chassis 36 both before and after the ear-piercing process when the carriage 34 is in place upon rear 108 and middle 110 portions of the chassis 36. As mentioned previously, the cover 38 has a U-shaped restraint support 92 that engages the bridge 90 of the carriage 34. The restraint support 92 prevents lateral motion of the longitudinal motion of the carriage 34 while providing additional stability to the cover 38 as it fits upon the chassis/carriage bridge construction. A small descending T-tab 180 is present at the opposite end of the cover 38 to the U-shaped restraint support 92. The descending T-tab 180 fits into the uppermost portion of the top lateral slot 138 to provide additional stability and support for the cover 38. Small runners or tabs 182 may be present on either side of an inwardmost indentation 184 present on either side of the cover 38. The small runners 182 may serve to engage the carriage channels 94, % when the stud 40 has been delivered and the carriage 34 is in its forward position upon the middle portion 110 of chassis 36. Generally, it is by friction fit that the cover 38 engages the chassis 36 and carriage 34.

Having described the construction and relationships between the carriage 34, chassis 36, and cover 38, the operation of the universal cartridge for pierced earrings of the present invention provides for sterile operation so that ears and other body parts may be pierced in a safe, sterile, and easy manner, thereby avoiding mistake and injury. As shown in FIGS. 9 through 13, the universal cartridge 30 is first fitted into the stud gun 32 at its forward cartridge-engaging end 190. In order to engage the universal cartridge 130, the driving pin 68 is pulled back and into the cocked position so as to make room for the universal cartridge 30.

The alignment projection 150 at the forward-most portion of the chassis 36 serves to align the chassis 36 with the cartridge-receiving portion 190 of the stud gun 32 in conjunction with the sides of the cartridge-engaging portion 190.

Figure 11:
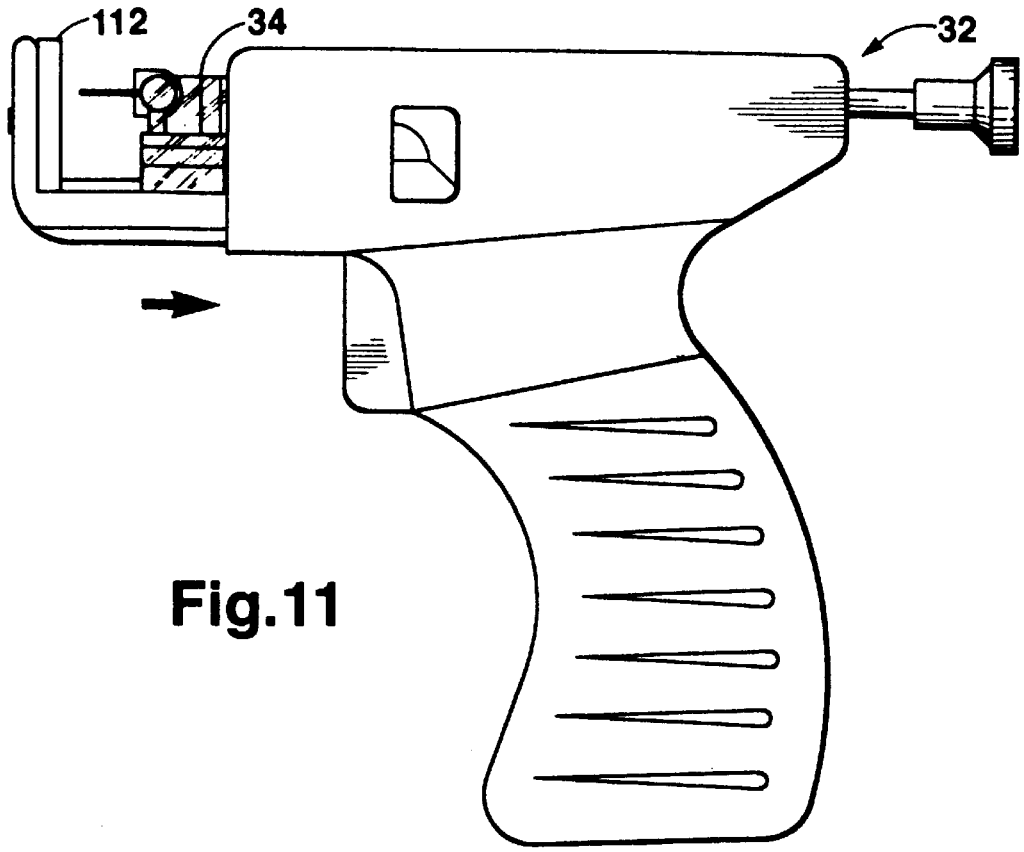
FIG. 11 shows a side elevational view of the stud gun and being positioned so as to better engage the ear during the piercing process, with the ear not being shown.
Figure 12:
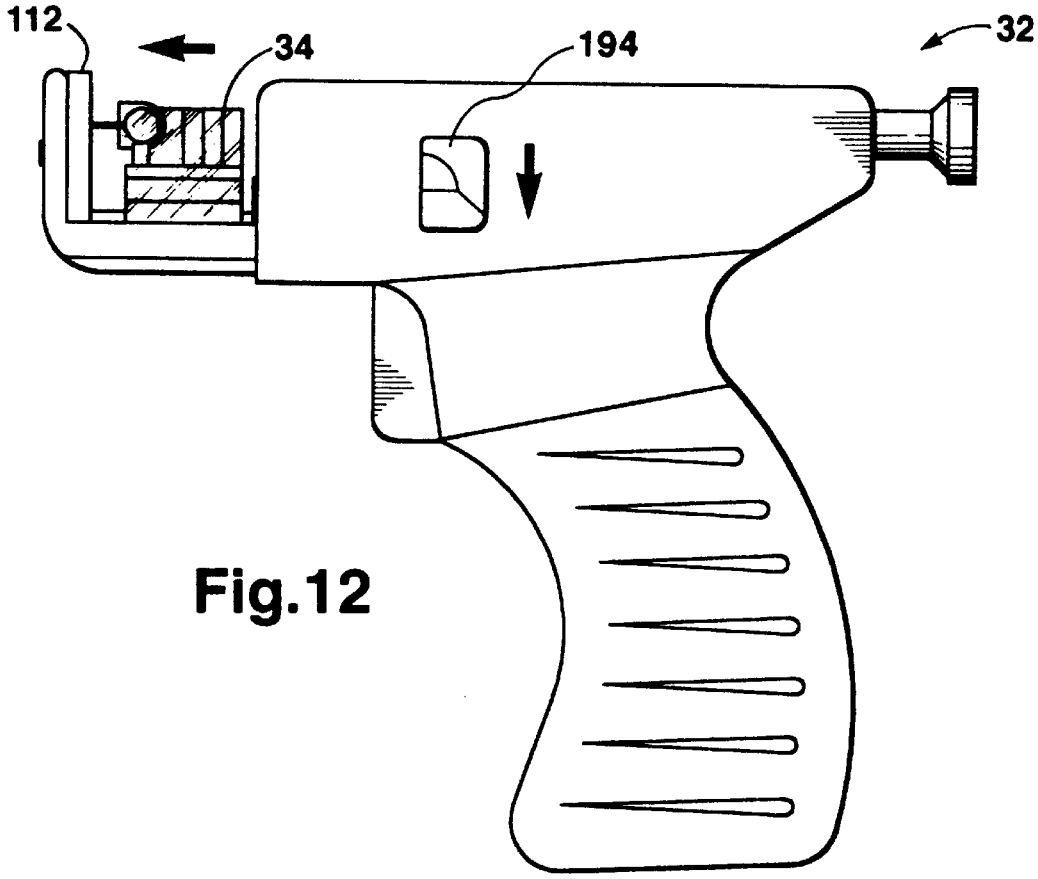
FIG. 12 is a side elevational view of the stud gun fitted with the universal cartridge after the trigger has been depressed and the pierced earring stud is forcefully driven to engage the clasp again the ear not being shown.

Upon fitting the chassis 36 into the cartridge-engaging portion 190 of the stud gun 32, the cover 38 is removed, such removal facilitated by the friction fit the cover 38 enjoys with the chassis 36 and carriage 34 once the removable seal has been removed. It should be noted that side protuberances 189 and 191 of cartridge-engaging portion 190 cooperate or co-engage with slots 119 and 121 of chassis 36 to ensure proper placement and alignment of cartridge 30 with stud gun 32. To aid in this alignment an inclined abutment stop 187 is provided at the forward end of cartridge-engaging portion 190 to engage in abutting fashion slot 135 of chassis 36. It should be further noted that the chassis 36 is fitted into the stud gun 32 without requiring the touch of or other contamination by human hands or the like. As the stud gun 32 is already cocked in order to receive the universal cartridge 30, FIG. 11 shows the retraction of the front-most portion of the cartridge-engaging end 190 of the stud gun 32 which simultaneously serves to engage the front end of the driving pin 68 into the pin apertures 64 of the carriage 34. The cartridge-engaging end 190 causes the driving pin 68 to push the carriage 34 forward towards the pierced earring nut 44.

In properly positioning the ear and in retracting the cartridge-engaging portion 190 of the stud gun 32, the ear is loosely but closely engaged between the pointed end of the stud post 42 and the forward-most end 112 of the chassis 36. Transparency of the cartridge 30 aids the stud gun user in accurately fixing the location for the stud to enter. Upon final positioning of the stud gun to orient the pierced earring to the preferred or particular place, the stud gun 32 is cocked by pressing trigger 193 until it can move no farther which then allows for the trigger release button 194 to be depressed, thereby releasing the stud gun pin 68 and rapidly driving the carriage 34 forwardly. The pierced earring post 42 is then driven through the ear and into the awaiting pierced earring nut 44, thereby piercing the ear.

As the carriage 34 travels forward, it is carried past the detents 124 which move inwardly past the sides of the carriage 34. The carriage is now held in a forward position past the detents preventing any backward or rearward travel of the carriage 34. As the driving pin 68 is removed from the leaf/pin aperture 64, the carriage is held in place by the detents 124 preventing its travel with the driving pin 68. Once the driving pin 68 is fully withdrawn from the leaf/pin aperture 64, the pressure or force applied by the tapering tabs 172 upon the downwardly-projecting tabs 104, 106 overcomes the left and right portions 50, 52 of the carriage 34, forcing them to disengage as they separate upon the rail 130. The carriage 34 thusly disengages the pierced earring stud 40 in a rapid fashion upon the withdrawal of the driving pin 68.

Figure 13:
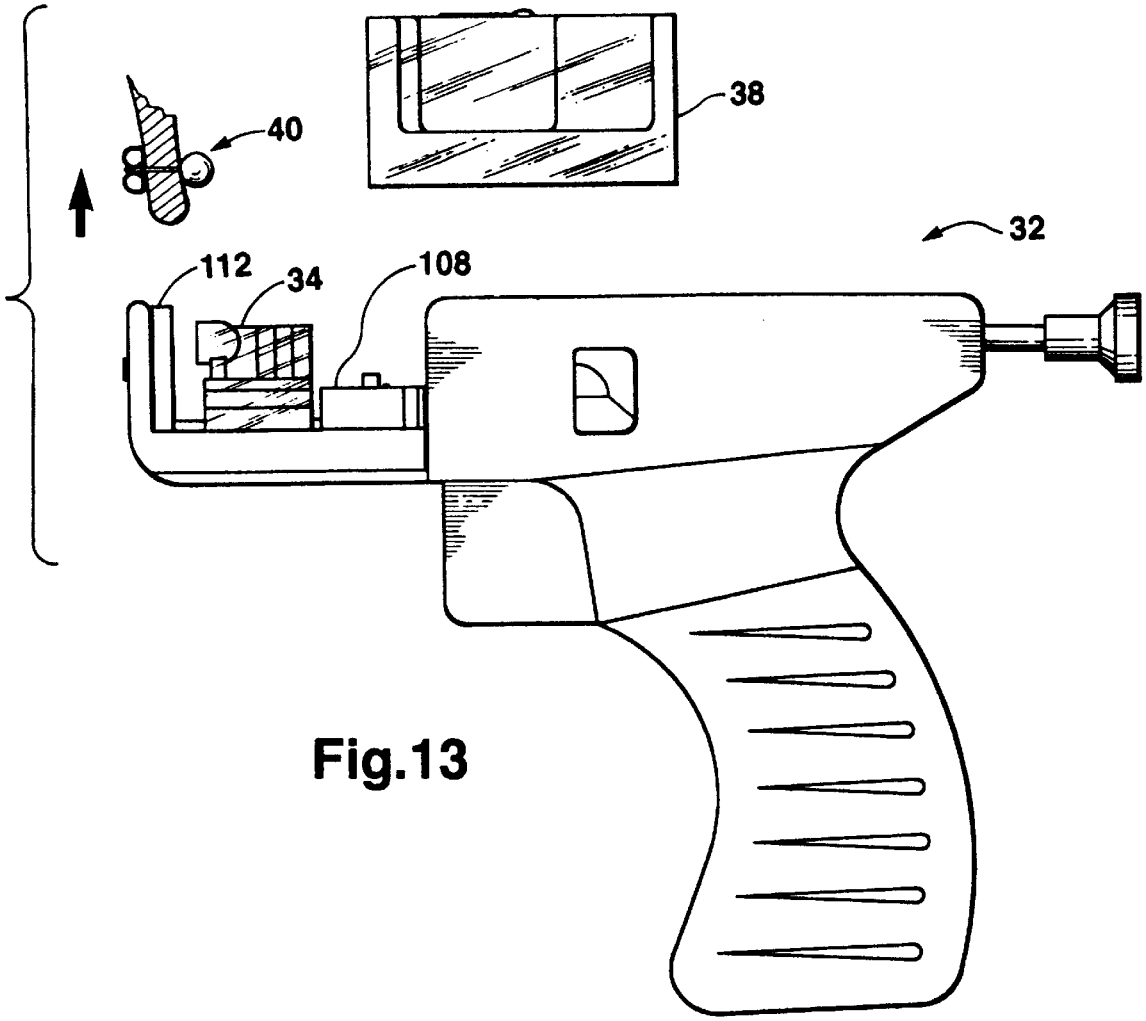
FIG. 13 is a side elevational view of the stud gun and universal cartridge system showing an ear disengaging the apparatus and the cover coming in to cover the remaining cartridge portion, engage it because of its compressible sides and thereby enabling its removal from the stud gun.
Figure 14:
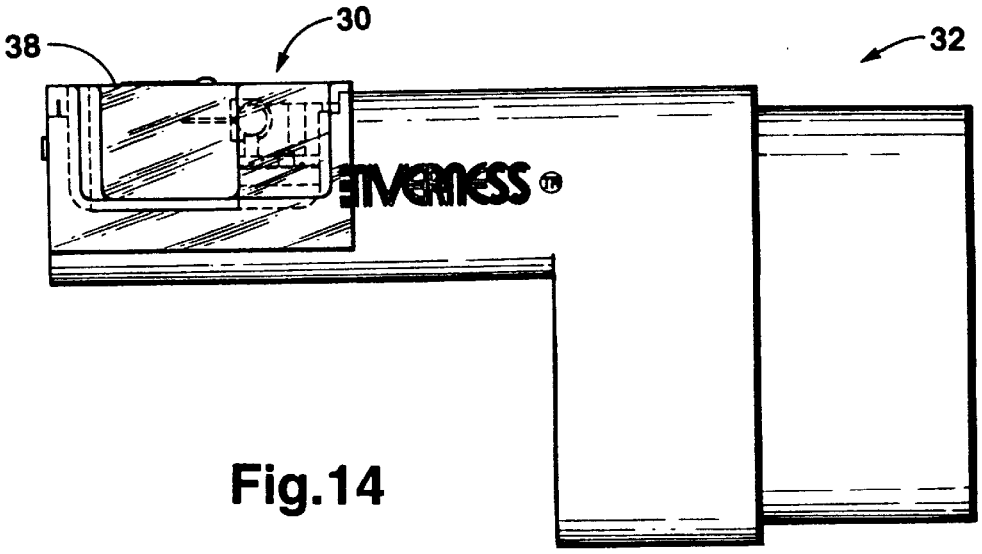
FIG. 14 is a side elevational view of the universal cartridge as it may be used in conjunction with an existing and a different type and style of stud gun.
Figure 15:
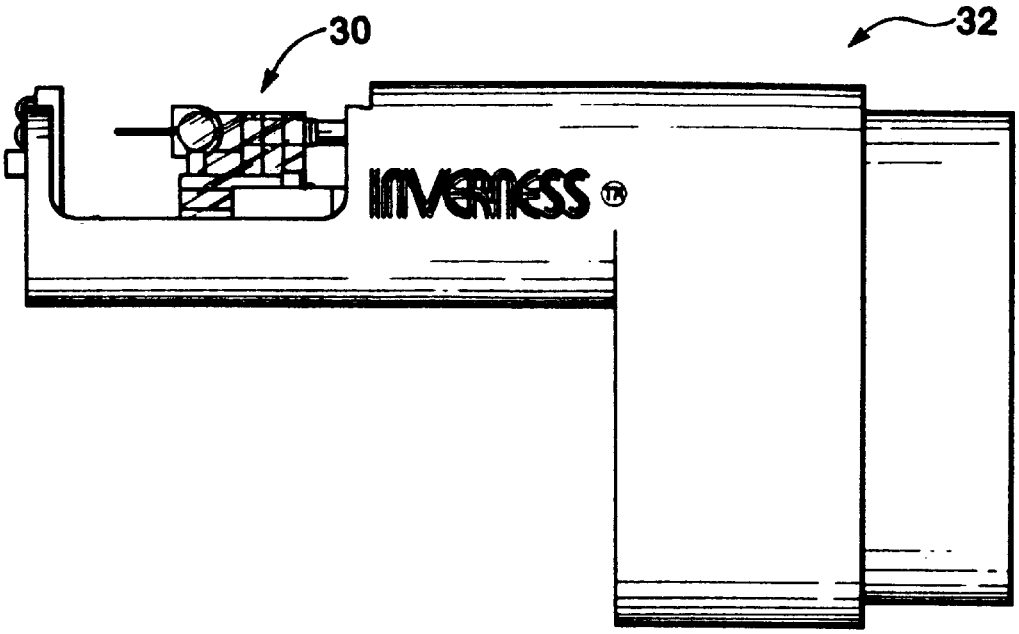
FIG. 15 shows the cartridge and gun of FIG. 14 with the transparent cover removed and the device readied for ear insertion.
Figure 16:
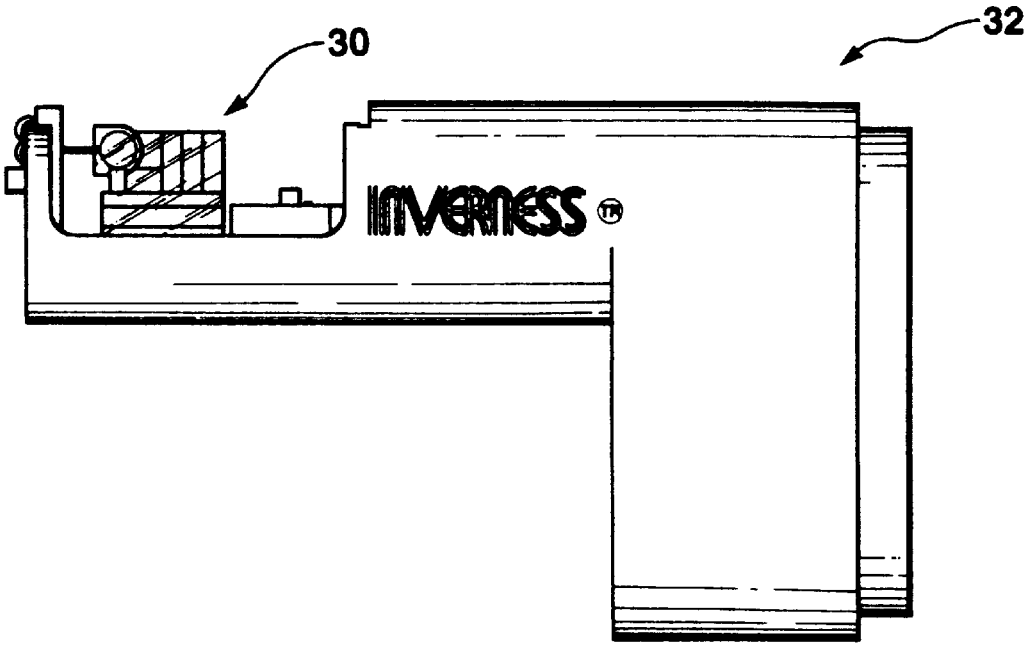
FIG. 16 shows the sequential step placement of the stud through the ear, not shown.
Figure 17:
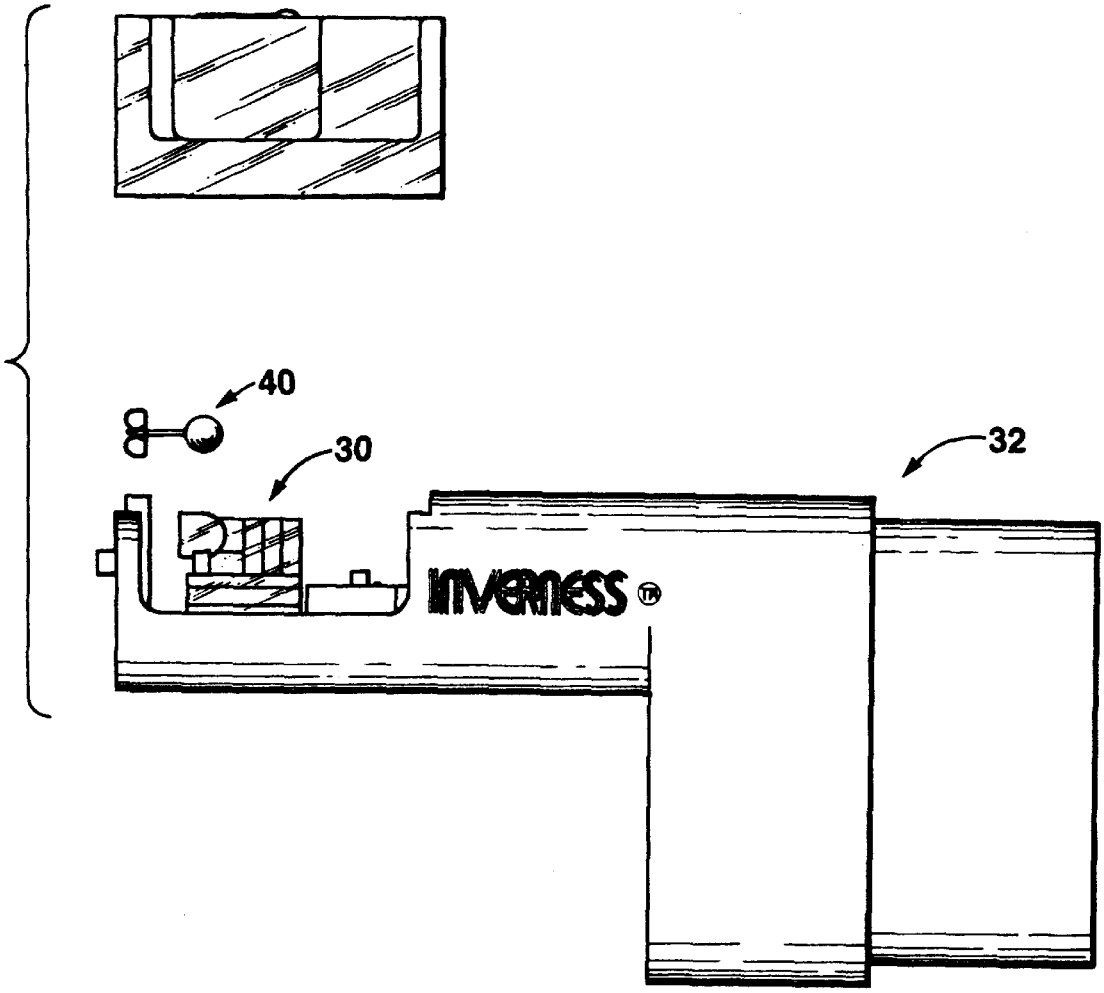
FIG. 17 shows the stud and clasp or nut associated with an ear with the transparent cover readied to remove the cartridge from the stud gun.

As the pierced earring nut is only loosely held by the slots 138, 140, and 152, downward motion of the stud gun 32 with the chassis 34 serves to entirely disengage the now-pierced ear from the stud gun and ear piercing apparatus (FIG. 13). The chassis 36 with its stud and nut or clasp retaining portions is designed for single use and is not easily adapted for stud and nut insertion thereby helping to ensure single use of the cartridge 30 for sanitary and health reasons. The ear is now pierced and may be antiseptically swabbed or otherwise treated in order to improve the disposition of the healing process. The cover 38 may now be brought to again frictionally fit over the chassis 36 and carriage 34, the carriage 34 now being held in a forward position by the detents 124. The small side tabs/side runners 182 present on the inside of cover 38 may now engage the carriage channels 94, 96 as the cover 38 generally presses the left and right carriage sides 50, 52 back into a more interlocked position. The driving pin is pulled back to its cocked position to remove it from the vicinity of the rear of the chassis 36. The chassis 36 has an open rear portion 160 generally only obstructed by the rear support 162. By grasping the cover 38 firmly and pressing the chassis 36 and carriage 34, the spent universal cartridge 30 may be removed from the cartridge-engaging portion 190 of the stud gun 32 as the forward alignment projection 150 is removed from the stud gun cartridge alignment slot 192. The stud gun 32 is now available to receive a second cartridge to perform an additional piercing procedure on the same individual or another. Throughout the ear-piercing procedure, contamination of the otherwise sterile pierced ear earring is avoided, enhancing the healing process and precluding risks of infection.

As shown on FIGS. 14–17, the universal nature of the universal cartridge 30 of the present invention allows it to be used by a stud gun taking a variety of shapes and forms.

While the present invention has been described with regards to particular embodiments, it is recognized that additional variations of the present invention may be devised without departing from the inventive concept thereof.

What is claimed is:

1. A universal cartridge for carrying pierced earrings components consisting of a stud and nut, the universal cartridge fitting a plurality of pierced earring stud guns, the universal cartridge comprising:

a chassis, said chassis able to support said earring nut in a fixed position;

a carriage, said carriage being slidably engaged upon said chassis, said carriage releasably carrying said stud in alignment with said pierced earring nut at its fixed position; and a transparent cover, said transparent cover removably engaging said chassis and said carriage in a friction-fit manner, said cover overlying a top portion of said chassis and said carriage when said carriage is slidably engaged to said chassis and allowing handling of said chassis and said carriage without direct and contaminating contact with said chassis and said carriage; whereby a stud gun receiving the universal cartridge may perform an ear-piercing procedure by driving said carriage toward said nut to cause said stud to pierce an intervening ear with said earring stud, said stud and said nut freely disengageable from the universal cartridge upon completion of said ear-piercing procedure.

2. The universal cartridge of claim 1, wherein said chassis further comprises:

a front upstanding portion capable of supporting said pierced earring nut in a fixed and freely disengageable position.

3. The universal cartridge of claim 2, wherein said chassis further comprises:

an alignment projection coupled to said front upstanding portion, said alignment projection aligning said front upstanding portion with a front portion of said stud gun when said universal cartridge is fitted to said stud gun.

4. The universal cartridge of claim 2, wherein said chassis further comprises:

a rear portion coupled to said front upstanding portion and having first and second oppositely opposed channel guides for slidably engaging said carriage.

5. A universal cartridge for carrying pierced earrings components consisting of a stud and nut, the universal cartridge fitting a plurality of pierced earring stud guns the universal cartridge comprising:

a chassis, said chassis able to support said earring nut in a fixed position;

a carriage, said carriage being slidably engaged upon said chassis, said carriage releasably carrying said stud in alignment with said pierced earring nut at its fixed position; and a cover, said cover removably engaging said chassis and said carriage, said cover allowing handling of said chassis and said carriage without direct and contaminating contact with said chassis and said carriage;

having a front upstanding portion capable of supporting said pierced earring nut in a fixed and freely disengageable position and having;

an alignment projection coupled to said front upstanding portion, said alignment projection aligning said front upstanding portion with a front portion of said stud gun when said universal cartridge is fitted to said stud gun;

said chassis further having a rear portion coupled to said front upstanding portion and having first and second oppositely opposed channel guides for slidably engaging said carriage;

and wherein said rear chassis portion further comprises:

first and second oppositely opposed flexible detents, said flexible detents corresponding to and extending forwardly from respective ones of said channel guides, said flexible detents preventing backward motion of said carriage once said carriage slides past forward ends of said detents, whereby a stud gun receiving the universal cartridge may perform an ear-piercing procedure by driving said carriage toward said nut to cause said stud to pierce an intervening ear with said earring stud, said stud and said nut freely disengageble from the universal cartridge upon completion of said ear-piercing procedure.

6. The universal cartridge of claim 5, wherein said rear chassis portion further comprises:

first and second inwardly extending tabs, said inwardly extending tabs corresponding to and extending inwardly from respective ones of said flexible detents, said extending tabs engaging said carriage and releasably fixing said carriage in place with respect to said chassis.

7. A universal cartridge for carrying pierced earrings components of a stud and nut, the universal cartridge fitting a plurality of pierced earring stud guns, the universal cartridge comprising:

a chassis, said chassis able to support said earring nut in a fixed position;

a carriage, said carriage being slidably engaged upon said chassis, said carriage releasably carrying said stud in alignment with said pierced earring nut at its fixed position; and a cover, said cover removably engaging said chassis and said carriage, said cover allowing handling of said chassis and said carriage without direct and contaminating contact with said chassis and said carriage; said chassis further having a front upstanding portion capable of supporting said pierced earring nut in a fixed and freely disengageable position and having an alignment projection coupled to said front upstanding portion, said alignment projection aligning said front upstanding portion with a front portion of said stud gun when said universal cartridge is fitted to said stud gun, said chassis further having a rear portion coupled to said front upstanding portion and having first and second oppositely opposed channel guides for slidably engaging said carriage, and wherein said chassis further comprises:

a middle portion disposed between said rear and front portions, said middle portion having a rail flanked by first and second flat landing portions, said rail defining first and second gaps between said rail and said first flat landing portion and said rail and said second landing portion, respectively, said rail extending rearwardly from said front portion and having a free end adjacent said rear portion, whereby a stud gun receiving the universal cartridge may perform an ear-piercing procedure by driving said carriage toward said nut to cause said stud to pierce an intervening ear with said earring stud, said stud and said nut freely disengageable from the universal cartridge upon completion of said ear-piercing procedure.

8. The universal cartridge of claim 7, wherein said middle chassis portion further comprises:

first and second oppositely opposed tabs, said tabs disposed beneath corresponding flat landing portions and slidably engaging said carriage; whereby said tabs urge said carriage to release said pierced earring stud.

9. The universal cartridge of claim 1, wherein said carriage further comprises:

first and second interlocking halves releasably entrapping said pierced earring stud in a pierced earring stud head holder.

10. The universal cartridge of claim 9, wherein said carriage further comprises:

first and second interlocking portions providing interlocking for said first and second interlocking halves, said first and second interlocking portions defining a stud gun pin aperture terminating in a stud gun pin stop, said first and second interlocking portions remaining interlocked if said stud gun pin aperture is obstructed as by a stud gun pin.

11. The universal cartridge of claim 9, wherein said carriage further comprises:

first and second oppositely opposed carriage channels, said carriage channels coupled to corresponding ones of said interlocking halves and providing slidable engagement with said chassis.

12. A universal cartridge for carrying pierced earrings components of a stud and nut, the universal cartridge fitting a plurality of pierced earring stud guns, the universal cartridge comprising:

a chassis, said chassis able to support said earring nut in a fixed position;

a carriage, said carriage being slidably engaged upon said chassis, said carriage releasably carrying said stud in aliment with said pierced earring nut at its fixed position; wherein said carriage further comprises:

first and second interlocking halves releasably entrapped said pierced earring stud in a pierced earring stud head holder, said carriage further comprising first and second oppositely opposed cartridge channels, said carriage channels coupled to corresponding ones of said interlocking halves and providing slidable engagement with said chassis;

and wherein said first and second carriage channels respectively define first and second oppositely opposed carriage channel notches, said carriage channel notches capable of receiving inwardly-urged tabs to releasably lock said carriage in place with respect to said chassis; and a cover, said cover removably engaging said chassis and said carriage, said cover allowing handling of said chassis and said carriage without direct and contaminating contact with said chassis and said carriage; whereby a stud gun receiving the universal cartridge may perform an ear-piercing procedure by driving said carriage toward said nut to cause said stud to pierce an intervening ear with said earring stud, said stud and said nut freely disengageable form the universal cartridge upon completion of said ear-piercing procedure.

13. A universal cartridge for carrying pierced earrings components of a stud and nut, the universal cartridge fitting a plurality of pierced earring stud guns, the universal cartridge comprising:

a chassis, said chassis able to support said earring nut in a fixed position:

a carriage, said carriage being slidably engaged upon said chassis, said carriage releasably carrying said stud in alignment with said pierced earring nut at its fixed position and having first and second interlocking halves releasably entrapping said pierced earring stud in a pierced carrying stud holder and wherein said carriage further comprises:

first and second oppositely opposed descending portions, said descending portions coupled to corresponding ones of said interlocking halves, each of said descending portions defining a one-quarter cylindrical concavedly curved groove, said groove of said first descending portion matching said groove of said second descending portion to define a semi-cylindrical concavedly curved groove for accommodating a rail or the like;

a cover, said cover removably engaging said chassis and said carriage, said cover allowing handling of said chassis and said carriage without direct and contaminating contact with said chassis and said carriage; whereby a stud gun receiving the universal cartridge may perform an ear-piercing procedure by driving said carriage toward said nut to cause said stud to pierce an intervening ear with said earring stud, said stud and said nut freely disengageable form the universal cartridge upon completion of said ear-piercing procedure.

14. The universal cartridge of claim 13, wherein said carriage further comprises:

first and second oppositely opposed descending tabs, said descending tabs coupled to corresponding ones of said descending portions, each of said descending tabs having a downwardly extending portion and an outwardly extending portion, said outwardly extending portions urging corresponding ones of said interlocking halves to separate outwardly generally along a longitudinal axis of said groove when said outwardly extending portions are urged inwardly towards one another.

15. A universal cartridge for carrying pierced earrings components of a stud and nut, the universal cartridge fitting a plurality of pierced earring stud guns, the universal cartridge comprising:

a chassis, said chassis able to support said earring nut in a fixed position;

a carriage, said carriage being slidably engaged upon said chassis, said carriage releasably carrying said stud in alignment with said pierced earring nut at its fixed position, said first carriage having first and second interlocking halves releasably entrapping said pierced earring stud in a pierced carrying stud holder and having first and second oppositely opposed carriage channels, said carriage channels coupled to corresponding ones of said interlocking halves and providing slidable engagement with said chassis and having a bridge, said bridge intermediating said first and second interlocking portions and said stud head holder, said bridge engageable by a U-shaped restraint support or the like;

a cover, said cover removably engaging said chassis and said carriage, said cover allowing handling of said chassis and said carriage without direct and contaminating contact with said chassis and said carriage; whereby a stud gun receiving the universal cartridge may perform an ear-piercing procedure by driving said carriage toward said nut to cause said stud to pierce an intervening ear with said earring stud, said stud and said nut freely disengageable form the universal cartridge upon completion of said ear-piercing procedure.

16. A universal cartridge for carrying pierced earrings components of a stud and nut, the universal cartridge fitting a plurality of pierced earring stud guns, the universal cartridge comprising:

a chassis, said chassis able to support said earring nut in a fixed position, a carriage, said carriage being slidably engaged upon said chassis, said carriage releasably carrying said stud in alignment with said pierced earring nut at its fixed position; and a cover, said cover generally conforms to and frictionally fits upon a top portion of said chassis and said carriage when said carriage is slidably engaged to said chassis removably engaging said chassis and said carriage, said cover allowing handling of said chassis and said carriage without direct and contaminating contact with said chassis and said carriage; whereby a stud gun receiving the universal cartridge may perform an ear-piercing procedure by driving said carriage toward said nut to cause said stud to pierce an intervening ear with said earring stud, said stud and said nut freely disengageable form the universal cartridge upon completion of said ear-piercing procedure.

17. The universal cartridge of claim 16, wherein said cover further comprises:

a U-shaped restraint support for engaging said carriage to maintain said carriage in a generally fixed position until said cover disengages said chassis and said carriage.

18. The universal cartridge of claim 17, wherein said cover further comprises:

a T-tab, said T-tab fitting into a slot present in said chassis, said slot allowing said chassis to engage said nut.

19. A universal cartridge for pierced earrings, the universal cartridge fitting a plurality of pierced earring stud guns, the universal cartridge comprising:

a chassis, said chassis able to support a pierced earring nut in a fixed position;

a carriage, said carriage slidably engaged upon said chassis, said carriage releasably carrying a pierced earring stud in alignment with said pierced earring nut at its fixed position;

a cover, said cover attachably detachably engaging said chassis and said carriage, said cover allowing handling of said chassis and said carriage without direct and contaminating contact with said chassis and said carriage, said cover generally conforming to and frictionally fitting upon a top portion of said chassis and said carriage when said carriage is slidably engaged to said chassis;

said chassis having a front upstanding portion capable of supporting said pierced earring nut in a fixed and freely disengageable position;

said chassis having an alignment projection coupled to said front upstanding portion, said alignment projection aligning said front upstanding portion with a front portion of a stud gun when said universal cartridge is fitted to said stud gun;

said chassis having a rear portion coupled to said front upstanding portion and having first and second oppositely opposed channel guides for slidably engaging said carriage;

said rear chassis portion having first and second oppositely opposed flexible detents, said flexible detents corresponding to and extending forwardly from respective ones of said channel guides, said flexible detents preventing backward motion of said carriage once said carriage slides past forward ends of said detents;

said rear chassis portion having first and second inwardly extending tabs, said inwardly extending tabs corresponding to and extending inwardly from respective ones of said flexible detents, said extending tabs engaging said carriage and releasably fixing said carriage in place with respect to said chassis;

said chassis having a middle portion disposed between said rear and front portions, said middle portion having a rail flanked by first and second flat landing portions, said rail defining first and second gaps between said rail and said first flat landing portion and said rail and said second landing portion, respectively, said rail extending rearwardly from said front portion and having a free end adjacent said rear portion;

said middle chassis portion having first and second oppositely opposed tabs, said tabs disposed beneath corresponding flat landing portions and slidably engaging said carriage, whereby said tabs urge said carriage to release said pierced earring stud;

said carriage having first and second interlocking halves releasably entrapping said pierced earring stud in a pierced earring stud head holder;

said carriage having first and second interlocking portions providing interlocking for said first and second interlocking halves, said first and second interlocking portions defining a stud gun pin aperture terminating in a stud gun pin stop, said first and second interlocking portions remaining interlocked if said stud gun pin aperture is obstructed as by a stud gun pin;

said carriage having first and second oppositely opposed carriage channels, said carriage channels coupled to corresponding ones of said interlocking halves and providing slidable engagement with said chassis upon said first and second channel guides, said first and second carriage channels respectively defining first and second oppositely opposed carriage channel notches, said carriage channel notches capable of receiving said inwardly extending tabs to releasably lock said carriage in place with respect to said chassis;

said carriage having first and second oppositely opposed descending portions, said descending portions coupled to corresponding ones of said interlocking halves, each of said descending portions defining a one-quarter cylindrical concavedly curved groove, said groove of said first descending portion matching said groove of said second descending portion to define a semi-cylindrical concavedly curved groove for accommodating said rail;

said carriage having first and second oppositely opposed descending tabs, said descending tabs coupled to corresponding ones of said descending portions, each of said descending tabs having a downwardly extending portion and an outwardly extending portion, said outwardly extending portions urging corresponding ones of said interlocking halves to separate outwardly generally along a longitudinal axis of said rail when said groove is upon said rail and said downwardly descending middle chassis portion tabs urge said outwardly extending portions of said descending tabs inwardly towards one another;

said carriage having a bridge, said bridge intermediating said first and second interlocking portions and said stud head holder;

said cover having a U-shaped restraint support for engaging said bridge to maintain said carriage in a generally fixed position until said cover disengages said chassis and said carriage; and said cover having a T-tab, said T-tab fitting into a slot present in said front upstanding chassis portion, said slot allowing said chassis to engage said nut; whereby a stud gun receiving the universal cartridge may perform an ear-piercing procedure by driving said carriage toward said nut to pierce an intervening ear with said pierced earring stud, said stud and said nut freely disengageable from the universal cartridge upon completion of said ear-piercing procedure.

20. A universal cartridge for carrying pierced earrings components of a stud and nut, the universal cartridge fitting a plurality of pierced earring stud guns, the universal cartridge comprising:

a chassis, said chassis able to support said earring nut in a fixed position;

a carriage, said carriage being slidably engaged upon said chassis, said carriage releasably carrying said stud in alignment with said pierced earring nut at its fixed position; and a transparent cover, said cover generally engaging said chassis and said carriage when said carriage is slidably engaged to said chassis in an overlying friction-fit manner, said cover having side interiorally directed, flexible walls having an interior contour conforming to the exterior contour of said chassis and carriage to allow handling of said chassis and said carriage without direct and contaminating contact with said chassis and said carriage; whereby a user of said universal cartridge may load and unload a stud gun receiving the universal cartridge in a facile and relatively sterile manner.

* * * * *